US005910782A

United States Patent [19]

Schmitt et al.

[11] Patent Number: 5,910,782

[45] Date of Patent: Jun. 8, 1999

[54] ON-BOARD VEHICLE PARKING SPACE FINDER SERVICE

[75] Inventors: Judith E. Schmitt; John E. Buchalo, both of Palatine, Ill.

[73] Assignee: Motorola, Inc., Schaumburg, Ill.

[21] Appl. No.: 08/805,536

[22] Filed: Feb. 25, 1997

[51] Int. Cl.[6] ..... G08G 1/123

[52] U.S. Cl. ..... 340/995; 340/932.2; 340/988; 340/990; 340/539; 701/202; 701/207; 701/209; 701/211

[58] Field of Search ..... 340/995, 932.2, 340/988, 990, 309.15, 539, 825.54, 825.49; 364/467, 444.1, 443, 436, 444.2, 449.2, 449.5, 448; 235/384; 194/214, 211, 902; 283/102

[56] References Cited

U.S. PATENT DOCUMENTS

| | | | |
|---|---|---|---|
| 5,004,997 | 4/1991 | Shisgal et al. | 340/436 |
| 5,091,727 | 2/1992 | Mahmood | 340/932.2 |
| 5,103,400 | 4/1992 | Yamada et al. | 364/444.2 |
| 5,115,399 | 5/1992 | Nimura et al. | 364/449.2 |
| 5,206,643 | 4/1993 | Eckelt | 340/932.2 |
| 5,293,163 | 3/1994 | Kakihara et al. | 340/995 |
| 5,432,508 | 7/1995 | Jackson | 340/932.2 |
| 5,442,348 | 8/1995 | Mushell | 340/932.2 |
| 5,454,461 | 10/1995 | Jacobs | 194/200 |
| 5,504,314 | 4/1996 | Farmont | 235/384 |

FOREIGN PATENT DOCUMENTS

4433982 C1 10/1995 Germany .

OTHER PUBLICATIONS

English Ti, AB for DE 4433982 C1, WPIDS Copyright 1997 Derwent Information LTD (one page).

*Primary Examiner*—Jeffery A. Hofsass
*Assistant Examiner*—Benjamin C. Lee
*Attorney, Agent, or Firm*—George C. Pappas

[57] ABSTRACT

An on-board vehicle navigation system parking space finder that offers a driver a competitive edge in finding available on-street parking. Drivers not familiar with an area are able to locate available metered parking spaces with ease. Drivers may be informed, on demand, of what type of currency they need for parking meters in certain areas, so they can stop for change, if necessary. Drivers will have information about maximum time limits for different parking meters, and can use this information to select meters with longer time limits, if necessary. Metered parking information specific to a vehicles current location, as well as metered parking information specific to a requested location, are made optionally available to drivers from within their vehicles.

21 Claims, 4 Drawing Sheets

ON-BOARD VEHICLE PARKING SPACE FINDER SERVICE

FIELD OF THE INVENTION

This invention is directed generally to the field of vehicle navigation systems and remote data acquisition systems, and more particularly, to such systems for use in finding available parking spaces.

BACKGROUND OF THE INVENTION

There is no easy way to find reasonably priced parking spaces in a busy city. Metered parking spaces represent less expensive parking alternatives than paying for garage parking, lot parking or valet parking. Available metered parking spaces can be impossible to find, however. The driver usually either wastes time driving around the area looking for an open space, or abandons the search, paying a large fee to park in a garage, or to use a valet parking service. It would be greatly advantageous to be able to provide a driver looking for a metered parking space with an on-board parking space finder of available on-street parking, and with a competitive edge over someone without such a parking space finder.

U.S. Pat. No. 5,293,163 to Kakihara, et al., entitled, "Navigation Apparatus for Vehicles", describes a system for finding garages or other parking facilities with available parking spaces. It provides for the display of available parking information in map format. This vehicle navigational system patent does not address the problem of locating available on-street parking. Instead, it addresses the problem of locating parking lots with available spaces. Parking lots in congested city areas are not very cost effective, and they may not be in close proximity to the driver's destination. The patent does not direct drivers directly to an available metered space, a less expensive alternative, but simply to a large parking lot where they will have to search for an available space. In addition, the Kakihara map display only directs the driver as far as a parking facility. The driver still must navigate around the parking facility to locate an available space.

U.S. Pat. No. 5,432,508 to Jackson, entitled, "Technique for Facilitating and Monitoring Vehicle Parking", describes a scheme for finding available parking spaces in garages and other parking facilities. It provides for the display of available parking information at the entrance of a garage and makes a provision for a light source to be mounted above a parking space to indicate its availability. Remote access to the data is provided by a dial-up telecommunication interface. Because the technique described operates over a wireline medium, it does not lend itself to being easily deployed in a wide area. Also, because parking information is never provided to any device within a vehicle, drivers still need to navigate through a garage to locate available spaces.

Parking meters with sensors, parking meters with transmitters, and navigational equipment receiving and displaying external information are well known in the art. U.S. Pat. No. 5,442,348 entitled, "Computerized Parking Meter", for example, describes a parking meter utilizing an ultrasonic transducer to detect when a car is occupying a parking space. Similarly, U.S. Pat. No. 5,454,461, entitled, "Electronic Parking Meter and System", describes a parking meter utilizing a sonar transducer for parked vehicle detection and radio means for receiving billing information.

At present, there is no on-board vehicle navigational system that delivers accurate and real time metered parking space information for access either from a central location, or directly by a vehicle, upon entering a specific geographic area. It would be a great advantage to drivers in busy cities to be able to do so.

DETAILED DESCRIPTION OF THE PREFERRED EMBODIMENTS

Generally, the present invention is directed to an on-board vehicle navigation system parking space finder that offers a driver a competitive edge in finding available on-street parking. Drivers not familiar with an area will be able to locate available metered parking spaces with ease. Drivers may be informed, on demand, of what type of currency they need for parking meters in certain areas, so they can stop for change, if necessary. Drivers will have information about maximum time limits for different parking meters, and can use this information to select meters with longer time limits, if necessary. Metered parking information specific to a vehicles current location, as well as metered parking information specific to a requested location, are made optionally available to drivers from within their vehicles.

An operating environment of the parking space finder service in accordance with a preferred embodiment of the present invention will now be described in connection with FIG. 1 together with associated flow diagrams shown in FIGS. 2–4.

Figure 1:
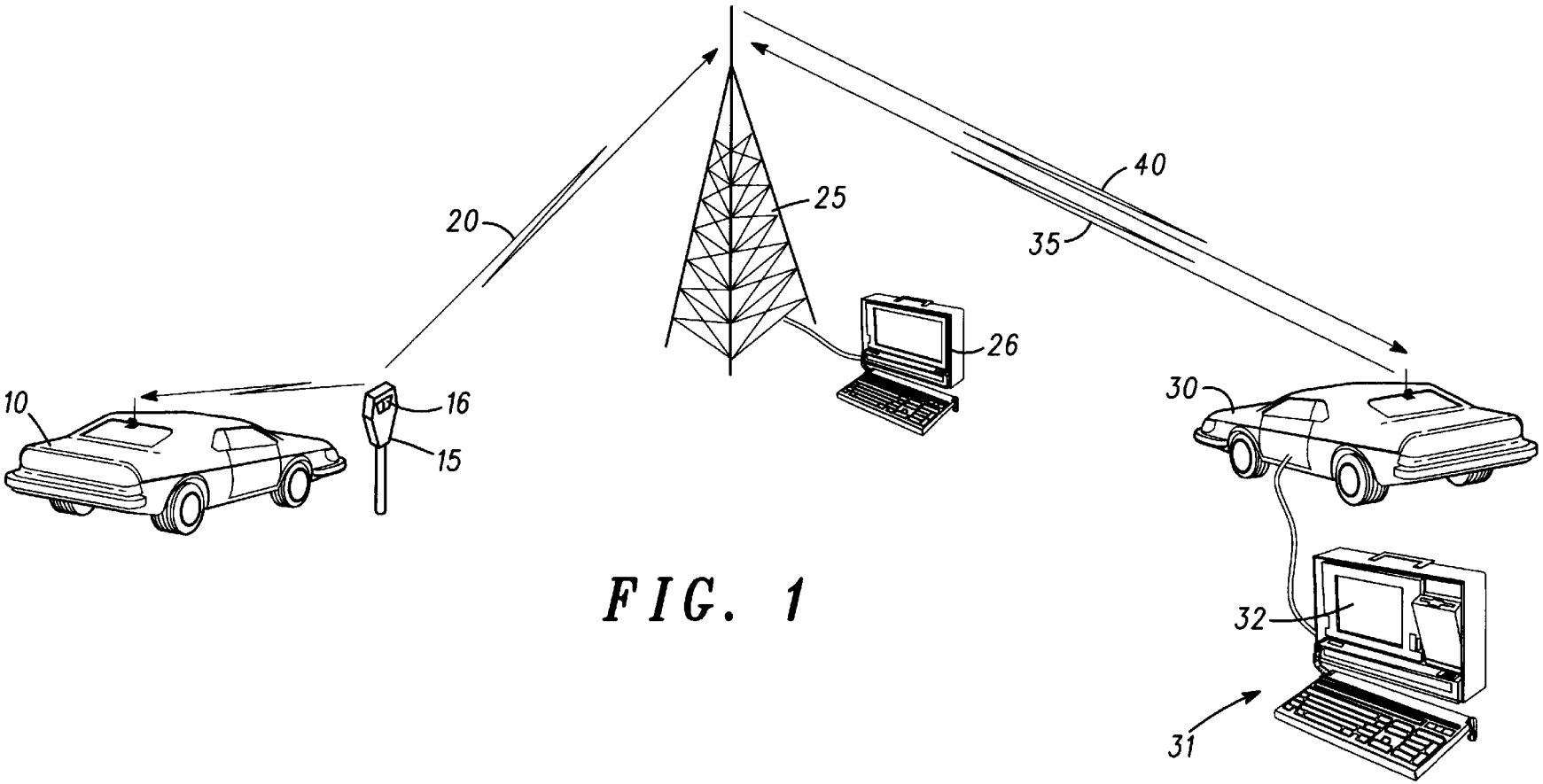
FIG. 1 is an illustration of a parking space finder service environment in accordance with the present invention.
Figure 2:
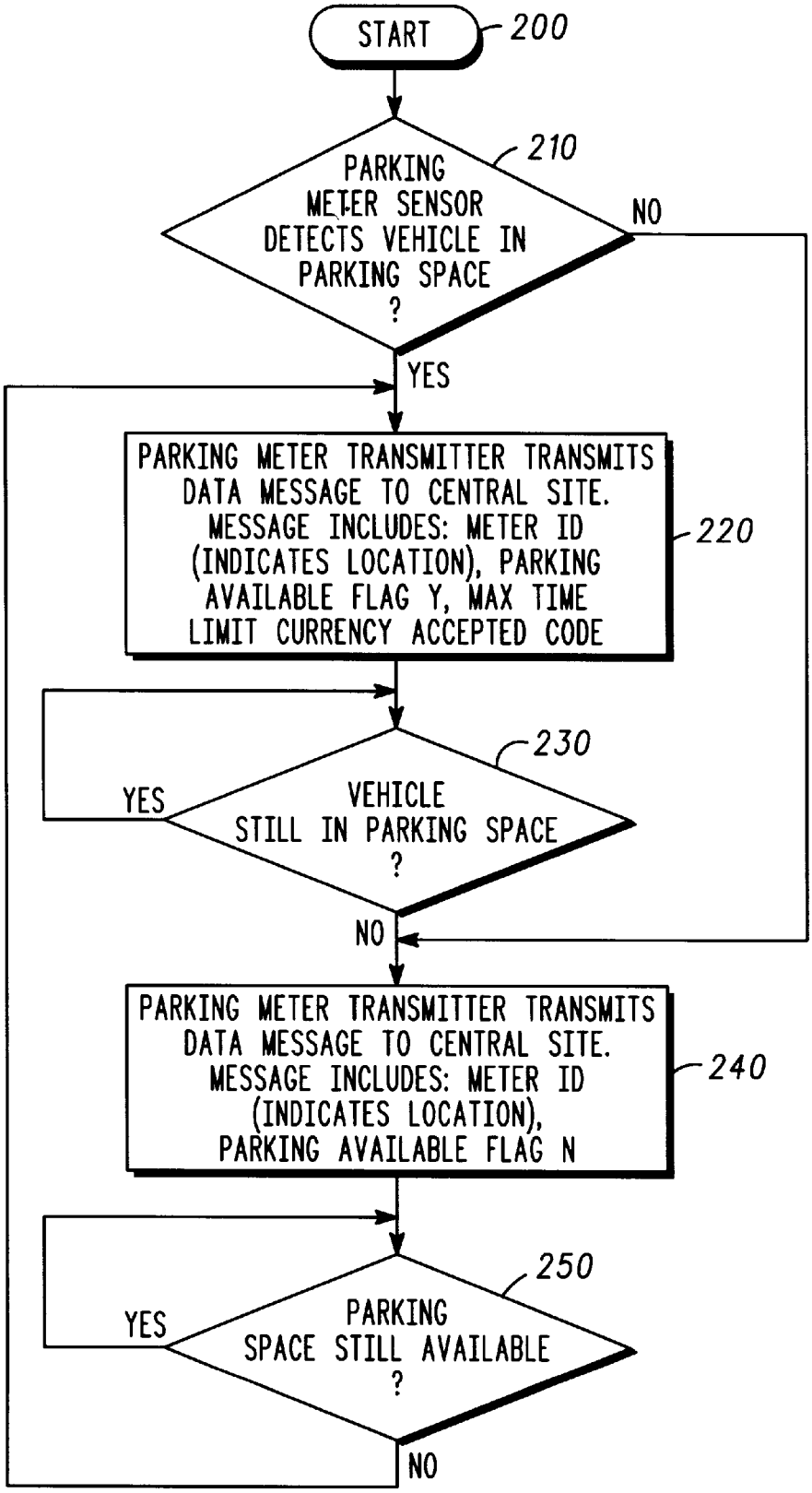
FIG. 2 is a flow diagram of the parking meter up-link operation in accordance with the present invention.

Referring to FIG. 1, when a vehicle 10 enters a parking space, the parking meter 15, equipped with an ultrasonic, sonar or other sensor device 16, senses the presence of the vehicle, and changes its internal state to "occupied". When the vehicle 10 leaves the parking space, the parking meter 15 senses this, and changes its internal state to "available".

As soon as the parking meter 15 detects a C.O.S (change of state), it will transmit a Status Change data message 20 to the nearby central site 25, where a receiver (not shown) is located. The data message 20 will include parking meter ID or location information and parking availability status information. The central site 25 passes the received data messages on to a computer 26 that maintains a database with all of the state information for the parking meters in a given area. In the instance where parking meters are configured to send ID information instead of location information, the database may be organized such that reference is made to the different parking meters by their respective IDs, corresponding to location information pre-programmed in the database. The parking meters 15 may alternatively be equipped with a small GPS receiver (not shown) (or hard-coded with location information locally) for communicating parking meter specific location information to the central site 25.

When in the "available" state, a meter 15 may optionally send additional information programmed in its memory, indicating its maximum time limit, and what kinds for example of coins (form of payment information) it accepts (quarters only, quarters and dimes, etc.). Alternatively, this information may be programmed into the central site database, corresponding to each parking meter ID.

When a driver in a vehicle 30 desires to locate available (on-street) parking information, a request for parking information must be initiated from an on-board navigation computer 31 or the like vehicle navigation system. The on-board computer 31 includes a display monitor 32 for displaying maps (see FIG. 5) which aid the driver in navigating to available parking spaces in a selected area. This initiation will trigger a request for information message 35 to be sent from the vehicle 30 to the central site 25.

This request 35 shall comprise, at a minimum, (i) a request for parking information, (ii) the ID of the vehicle 30 requesting parking information (this is necessary in the instance where drivers are subscribing to a monthly service), (iii) the present location of the vehicle 30 requesting the information (this will allow the central site to send parking information specific to the area in which vehicle 30 requesting the update is traveling, and/or (iv) the location of a specific area, other than in which the vehicle 30 is traveling, in which parking information is desired.

It is alternatively also envisioned that no request for parking information may be sent from the vehicle 30 and that parking information may instead be transmitted on a constant interval to all vehicles which have the capability to monitor the information.

Upon receiving the request 35, the central site computer 26 will process the request, including performing a validation of the vehicle ID requesting the information, and lookup parking information (from the associated database) corresponding to a pre-programmed region in the area in which the vehicle was located when the request was made (or in the area in which parking information was requested).

After the parking information lookup is completed, the information is transmitted by the central site computer 26 in a parking space availability message 40 to the vehicle 30 which requested the information. The transmission of the message 40 includes the ID of the requester as well as the area parking availability information. It is also possible to have the central site 25 transmit parking information for "all" areas in which the central site 25 maintains parking availability information, and to broadcast such information at constant intervals to all vehicles 30 in its area capable of processing it (i.e., those vehicles that comprise an on-board navigation computer 31).

Upon receiving the parking space availability message 40 from the central site 25, the vehicle 30 on-board computer 31 will process the information and display it to the requester, via for example user-friendly maps (51, 52—FIG. 5) viewable on monitor 32. Display of a specific area's parking information will be based upon the map location currently being viewed.

It should be appreciated that the parking space finder features of the present invention can be utilized in a manner which allows a service provider to charge a monthly, or transaction based fee for allowing vehicle owners to utilize the parking space finder service described herein.

Also, because meter utilization information is collected at one central location (central site(s) 25), statistically relevant data can be collected about area parking meter usage and used by local governing authorities (or local parking lots) to set, for example, appropriate rates for their respective parking services.

It is also envisioned that the parking space finder service described in connection with the present invention can be expanded such that additional information, which a driver might find useful, is transmitted by the central site 25 in the parking availability message 40 to the requesting vehicle 30. Such information may include, but is not limited to, information about (i) any no-parking provisions for available parking spaces; (ii) parking meter 15 rates; and (iii) acceptable forms of payment. Acceptable forms of payment may in the future include credit cards, smart cards (also commonly referred to as IC cards), and automatic debit systems, such as is presently becoming popular with transportation toll debit systems like IPASS™.

In the preferred embodiment, a central site 25 is utilized to transmit parking space availability information to vehicles equipped with the appropriate parking space finder navigation equipment. It is envisioned, however, that meter status information (for at least limited coverage areas—several street blocks only) may be communicated directly to vehicles 30 equipped with an on-board navigation computer 31, without use of a central site agent.

The parking meter up-link operation will now be described in connection with FIG. 2. A parking meter sensor 16 continually monitors the local area in and around an associated parking space to detect vehicles coming in and out of the space (210). When a vehicle 10 is detected, the parking meter 15 transmits a data message to the central site 25 including, as previously explained, the meter ID, parking space availability status, the maximum time limit for the meter 15, and a currency accepted code (220). When a vehicle is not in the space, or immediately when the vehicle 10 leaves the space (230), the parking meter transmits a data message to the central site 25 including the meter ID and an updated parking space availability status (240). When the empty space becomes occupied, the new availability condition is detected and a new status message transmitted to the central site 25.

Figure 3:
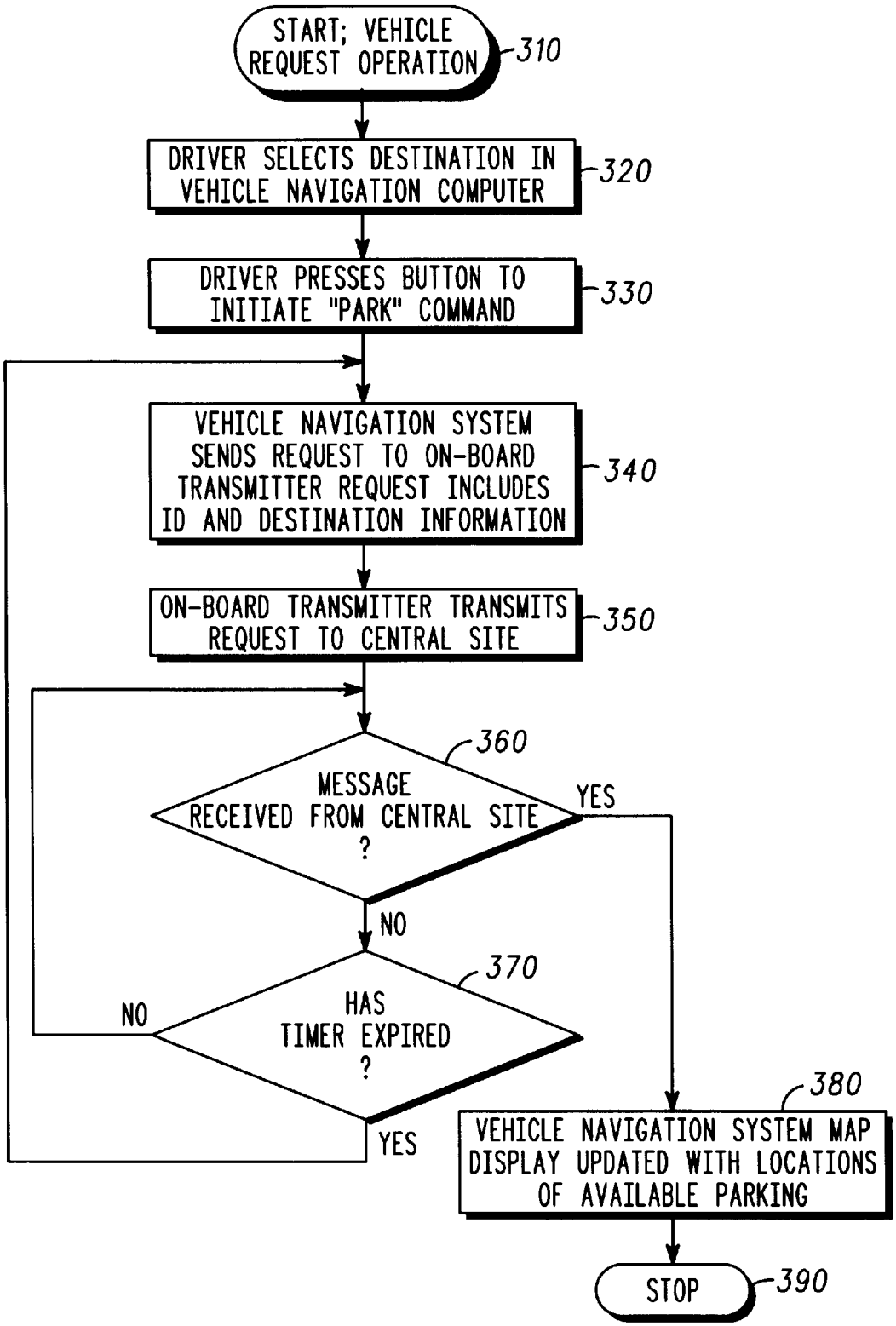
FIG. 3 is a flow diagram of the vehicle initiated parking space finder operation in accordance with the present invention.
Figure 4:
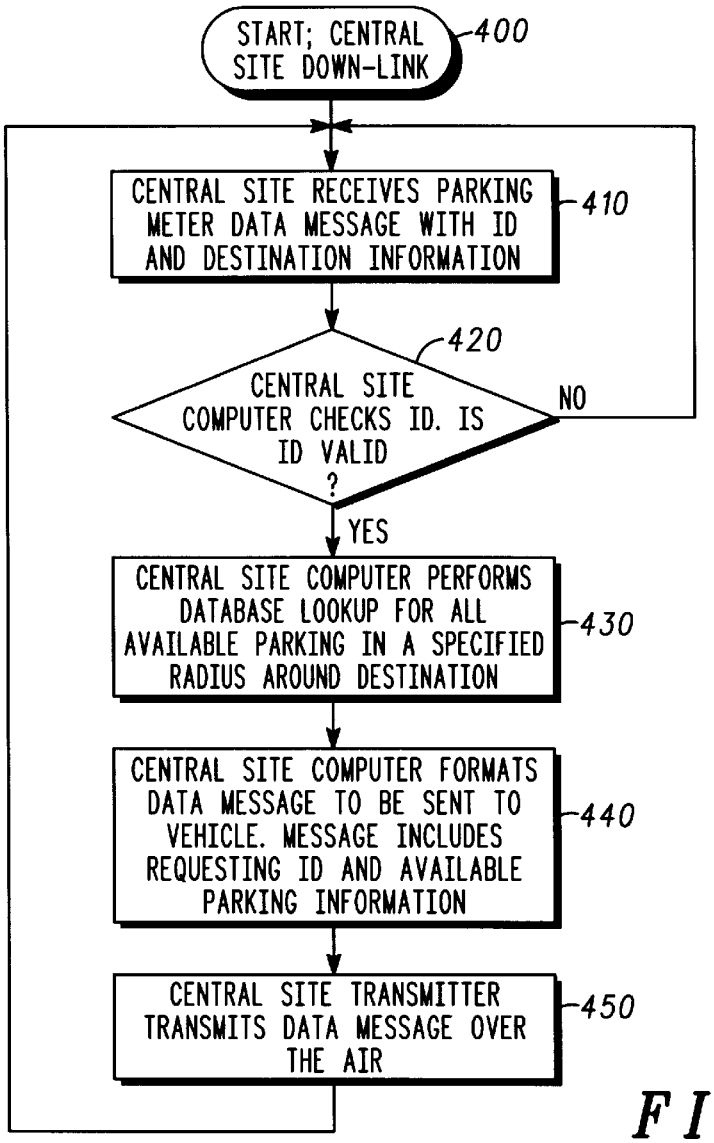
FIG. 4 is a flow diagram of the central site down-link operation in accordance with the present invention.

When a driver is looking for an available (free) space, he initiates a vehicle request operation, such as may be implemented by the routine of FIG. 3. In the illustrative example, the driver selects a destination from the vehicle navigation computer 31 located on-board the vehicle 30 (320). The driver may, for example, depress a "park" button (330) to initiate the parking availability request 35 to an on-board transmitter (not shown) (340). The on-board transmitter, in response, transmits the request to the central site 25 (350). The on-board computer 31 waits a predetermined time for a reply message 40 from the central site, before another reattempt to communicate therewith (360, 370).

The operation of the central site 25 will now generally be described in connection with the central site down-link routine shown in FIG. 4. The central site 25 maintains parking meter data message 20 information from participating meters 15 in its area of coverage. The central site 25 also looks for and monitors the relevant coverage area(s) for parking availability requests from vehicles 30 (410). When a message is received, the central site computer 26 checks the vehicle transmitted ID and compares it to a list of valid IDs (420). If valid, the central site computer 26 performs a database lookup for all available parking in a specified radius around destination (430). The central site computer 26 then formats the response message 40 to be sent to the requesting vehicle, including sending its ID and parking availability information (440), and then finally transmits the message 40 (450).

Figure 5:
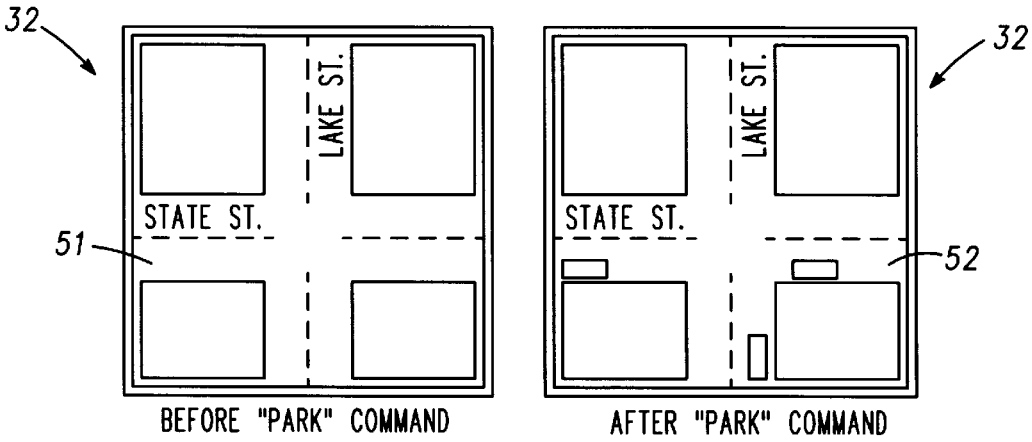
FIG. 5 shows "before" and "after" park request vehicle navigation maps.

FIG. 5 shows graphical depictions of "before" and "after" park-request vehicle navigation maps 51, 52, seen by the driver on the display monitor 32 of the on-board navigation computer 32. The maps 51, 52 assist the driver to locate and navigate to the desired "closest"available parking space(s).

Although the invention has been described in terms of a preferred embodiment, it will be obvious to those skilled in the art that many modifications and alterations may be made without departing from the invention. Accordingly it is intended that all such modifications and alterations be considered as within the spirit and scope of the invention as defined by the appended claims.

We claim:

1. A method of delivering parking availability information to a driver in a vehicle equipped with an on-board navigational computer, the method comprising the on-board navigational computer performed steps of:

receiving a driver request to initiate a parking availability request;

transmitting the parking availability request over a wireless medium to a central site;

receiving a response message representative of current parking availability information in a geographic area from the central site, the central site collecting parking availability information transmitted from sensor devices monitoring associated parking spaces, said parking spaces comprising at least one on-street parking space; and generating navigational information as a function of said parking availability information to assist the driver in locating an available parking space.

2. The method of claim 1, wherein said geographic area is an area specific to a driver requested location.

3. The method of claim 1, wherein said geographic area is an area specific to a current location of the vehicle.

4. The method of claim 1, wherein said navigational information is navigational maps of the geographic area and includes positional information of currently available parking spaces.

5. The method of claim 1, wherein said parking availability request and said response message include vehicle identification information.

6. The method of claim 1, wherein said parking availability request includes information of a current position of the vehicle.

7. The method of claim 1, wherein said parking availability information includes an availability status of parking meters in the geographic area.

8. The method of claim 7, wherein said parking availability information further includes form of payment information about at least available ones of said parking meters.

9. The method of claim 7, wherein said parking availability information further includes maximum time limit information about at least available ones of said parking meters.

10. The method of claim 7, wherein said parking availability information further includes specific parking provisions for associated parking meters.

11. A method of delivering parking availability information to a driver in a vehicle equipped with an on-board navigational computer, the method comprising the on-board navigational computer performed steps of:

receiving a driver request to initiate a parking availability request;

in response to said parking availability request, detecting current parking availability information for at least one geographic area transmitted over a wireless medium from a central site, the central cite collecting parking availability information transmitted from sensor devices monitoring associated parking spaces, said parking spaces comprising at least one on-street parking space; and generating navigational information as a function of said parking availability information to assist the driver in locating an available parking space.

12. The method of claim 11, wherein said at least one geographic area is an area specific to a current location of the vehicle.

13. The method of claim 11, wherein said navigational information is navigational maps of the geographic area and includes positional information of currently available parking spaces.

14. The method of claim 11, wherein said parking availability information includes an availability status of parking meters in said at least one geographic area.

15. The method of claim 14, wherein said parking availability information further includes at least one of form of payment information, maximum time limit information, and specific parking provisions about at least available ones of said parking meters.

16. In a central site including a central site computer, a method of generating parking availability information to a driver in a vehicle equipped with an on-board navigational computer, the method comprising the central site computer performed steps of:

receiving parking availability information transmitted from sensor devices monitoring associated parking spaces, said parking spaces comprising at least one on-street parking space;

maintaining a database of current parking availability information as a function of at least one geographic area; and transmitting, over a wireless medium, navigational information representative of said current parking availability information to assist the driver in locating an available parking space.

17. The method of claim 16, wherein said step of transmitting navigational information is in response to a parking availability request from the vehicle.

18. The method of claim 16, wherein said step of transmitting navigational information occurs at constant time intervals.

19. The method of claim 16, wherein said current parking availability information includes an availability status of parking meters in said at least one geographic area.

20. The method of claim 19, wherein said parking availability information further includes at least one of form of payment information, maximum time limit information, and specific parking provisions about at least available ones of said parking meters.

21. A method of delivering parking availability information to a driver in a vehicle equipped with an on-board navigational computer, the method comprising the on-board navigational computer performed steps of:

receiving a driver request to initiate a parking availability request;

in response to said parking availability request, detecting current parking availability information, transmitted over a wireless medium, from each of plural parking meters having a respective associated sensor device for monitoring corresponding parking spaces in proximate location to the vehicle, said parking spaces comprising at least one on-street parking space; and generating navigational information as a function of said parking availability information to assist the driver in locating an available parking space.

* * * * *